US007312565B2

(12) United States Patent
Taniwa et al.

(10) Patent No.: US 7,312,565 B2
(45) Date of Patent: Dec. 25, 2007

(54) COLOR CATHODE RAY TUBE APPARATUS

(75) Inventors: Kenichiro Taniwa, Takatsuki (JP); Etsuji Tagami, Takatsuki (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 0 days.

(21) Appl. No.: 11/522,762

(22) Filed: Sep. 18, 2006

(65) Prior Publication Data

US 2007/0103049 A1 May 10, 2007

(30) Foreign Application Priority Data

Nov. 7, 2005 (JP) ..... 2005-322662

(51) Int. Cl.
*H01J 29/70* (2006.01)

(52) U.S. Cl. ..... 313/440; 335/211; 335/212

(58) Field of Classification Search ..... 335/210–215; 313/440

See application file for complete search history.

(56) References Cited

U.S. PATENT DOCUMENTS

| | | | | |
|---|---|---|---|---|
| 5,378,961 | A * | 1/1995 | Shiro et al. | 313/440 |
| 6,124,669 | A * | 9/2000 | Okamoto | 313/431 |
| 6,831,400 | B2 | 12/2004 | Takahashi et al. | |
| 2005/0140263 | A1* | 6/2005 | Sakurai et al. | 313/440 |
| 2007/0182305 | A1* | 8/2007 | Iwasaki | 313/440 |

FOREIGN PATENT DOCUMENTS

| | | |
|---|---|---|
| JP | 7-15736 | 1/1995 |
| JP | 2001-52631 | 2/2001 |
| JP | 2001-126642 | 5/2001 |
| JP | 2002-260558 | 9/2002 |

* cited by examiner

*Primary Examiner*—Ramon M. Barrera
(74) *Attorney, Agent, or Firm*—Hamre, Schumann, Mueller & Larson, P.C.

(57) ABSTRACT

In the vicinity of an end on the side of a large diameter portion of a deflection device, a pair of first permanent magnets for converging three electron beams in an X-axis direction and a pair of second permanent magnets for diverging them in the X-axis direction are provided. Inclination coefficients $K_{TBH}$ and $K_{EWH}$ of the distribution curve near the Z axis on the X axis of the Y-axis direction magnetic flux density of the magnetic fields respectively formed by the pair of first permanent magnets and the pair of second permanent magnets satisfy $K_{TBH}/K_{EWH}<10$ in at least one location within a range of 3 to 13 mm on the side of the phosphor screen with respect to a reference line in the Z-axis direction. An inclination coefficient $K_H$ of the distribution curve near the Z axis on the X axis of the Y-axis direction magnetic flux density of a combination magnetic field formed by the pair of first permanent magnets and the pair of second permanent magnets and an inclination coefficient $K_V$ of the distribution curve near the Z axis on the Y axis of the X-axis direction magnetic flux density of the combination magnetic field are both larger than 1.5 (Gauss/cm) in at least one location within the above-noted range. This achieves excellent spot shapes, thus making it possible to reduce change in convergence characteristics due to temperature variation and pincushion distortion of right and left rasters.

8 Claims, 7 Drawing Sheets

COLOR CATHODE RAY TUBE APPARATUS

BACKGROUND OF THE INVENTION

1. Field of the Invention

The present invention relates to a color cathode ray tube apparatus used for a TV, a monitor or the like.

2. Description of Related Art

Nowadays, a so-called self-convergence in-line color cathode ray tube apparatus is in wide use. This color cathode ray tube apparatus includes an in-line electron gun for emitting three aligned electron beams of a center beam and a pair of side beams on both sides of the center beam that pass in the same horizontal plane, a deflection device for generating a pincushion horizontal deflection magnetic field and a barrel vertical deflection magnetic field, and a pair of upper and lower permanent magnets or a pair of upper and lower and a pair of right and left (a set of four) permanent magnets provided at an edge portion of a screen-side opening of the deflection device for assisting these horizontal and vertical deflection magnetic fields. In this color cathode ray tube apparatus, the three electron beams are converged over an entire screen, and the electron gun and the deflection device are combined so that deflection distortion (raster distortion) in upper and lower portions or upper, lower, right and left portions of the screen is corrected to be substantially linear.

In such a self-convergence in-line color cathode ray tube apparatus, the electron gun generally emits the side beams at predetermined angles so as to converge the three electron beams at the center of the screen. The state of convergence of the three electron beams at the center of the screen is adjusted by a CPU (Convergence and Purity Unit) formed of a ring-shaped magnet provided in a neck portion of the color cathode ray tube apparatus.

Conventionally, suggestions have been made to provide the deflection device with various auxiliary devices, thereby improving the shapes of spots of the electron beams on the screen (in the following, simply referred to as the "spots") while maintaining the convergence characteristics of the three electron beams, and at reducing a variation in the convergence characteristics due to temperature variation. For example, JP 2002-260558 A discloses that, in addition to the above-noted permanent magnets, an auxiliary magnetic field generating device for generating a quadrupole magnetic field 92 shown in FIG. 12 is provided at a position overlapping a horizontal deflection coil in a tube axis direction. In FIG. 12, numeral 91 denotes a magnetic core constituting the deflection device, and numerals 18B, 18G and 18R denote three electron beams. Also, JP 2001-52631A, JP 7(1995)-15736A and JP 2001-126642A disclose that the deflection device is provided with a temperature compensating device in order to reduce the variation in the convergence characteristics due to the temperature variation.

In recent years, there have been increasing demands for a higher quality and a lower cost for a television set using a color cathode ray tube apparatus. Therefore, it has become difficult in terms of cost to add the auxiliary magnetic field generating device so as to achieve a higher quality.

According to the above-described configuration disclosed in JP 2002-260558A, the convergence characteristics and the spot shape improve. However, since a magnetic force of the auxiliary magnetic field generating device varies due to the temperature variation, the convergence characteristics varies, causing a problem of deteriorating image quality. Further, since a pincushion quadrupole magnetic field generated by the auxiliary magnetic field generating device shown in FIG. 12 and a barrel magnetic field generated by a vertical deflection coil cancel each other out, it is difficult to achieve both of the convergence characteristics and the correction of raster distortion. Accordingly, in order to correct the raster distortion, a correction circuit needs to be added to a television set, for example, leading to a problem of the apparatus becoming more complicated and expensive.

In the configurations disclosed by JP 2001-52631A and JP 7(1995)-15736A, although the variation in convergence characteristics due to the temperature variation can be reduced, the spot shape cannot be improved. Also, there is a problem that the configuration becomes complicated and thus the apparatus becomes expensive.

In the configuration disclosed by the JP 2001-126642A, it is difficult to improve the spot shape and correct the pincushion distortion of right and left rasters. Moreover, there is a problem that the configuration becomes complicated.

SUMMARY OF THE INVENTION

The present invention was made in order to solve the above-described problems of the conventional color cathode ray tube apparatus, and the object of the present invention is to provide a high-resolution inexpensive color cathode ray tube apparatus that achieves excellent spot shapes with a simple configuration without adding an auxiliary correcting device, reduces variation in convergence characteristics due to temperature variation and further reduces pincushion distortion of right and left rasters.

A color cathode ray tube apparatus according to the present invention includes a color cathode ray tube having an electron gun for emitting three electron beams that are aligned in a horizontal direction and a phosphor screen that emits light when struck by the three electron beams emitted from the electron gun, and a deflection device having a horizontal deflection coil that generates a horizontal deflection magnetic field for deflecting the three electron beams in the horizontal direction and a vertical deflection coil that generates a vertical deflection magnetic field for deflecting the three electron beams in a vertical direction.

The deflection device further includes a pair of first permanent magnets that are arranged on a vertical axis symmetrically with respect to a tube axis so that the three electron beams are converged in the horizontal direction near the tube axis and a pair of second permanent magnets that are arranged on a horizontal axis symmetrically with respect to the tube axis so that the three electron beams are diverged in the horizontal direction near the tube axis.

$K_{TBH}/K_{EWH}<10$ is satisfied in at least one location within a range of 3 to 13 mm on a side of the phosphor screen with respect to a reference line in a tube axis direction, where $K_{TBH}$ (Gauss/cm) is an inclination coefficient of a distribution curve near the tube axis on the horizontal axis of a vertical direction magnetic flux density of a magnetic field formed by the pair of first permanent magnets and $K_{EWH}$ (Gauss/cm) is an inclination coefficient of the distribution curve near the tube axis on the horizontal axis of a vertical direction magnetic flux density of a magnetic field formed by the pair of second permanent magnets.

$K_H>1.5$ and $K_V>1.5$ are satisfied in at least one location within the range of 3 to 13 mm on the side of the phosphor screen with respect to the reference line in the tube axis direction, where $K_H$ (Gauss/cm) is an inclination coefficient of a distribution curve near the tube axis on the horizontal axis of a vertical direction magnetic flux density of a combination magnetic field formed by the pair of first permanent magnets and the pair of second permanent magnets and $K_V$ (Gauss/cm) is an inclination coefficient of a distribution curve near the tube axis on the vertical axis of a horizontal direction magnetic flux density of the combination magnetic field.

DETAILED DESCRIPTION OF THE INVENTION

In accordance with the present invention, it is possible to provide a high-resolution inexpensive color cathode ray tube apparatus that achieves excellent spot shapes with a simple configuration without adding an auxiliary correcting device, reduces variation in convergence characteristics due to temperature variation and further reduces pincushion distortion of right and left rasters.

The following is a description of a color cathode ray tube apparatus according an embodiment of the present invention, with reference to the accompanying drawings.

Figure 1:
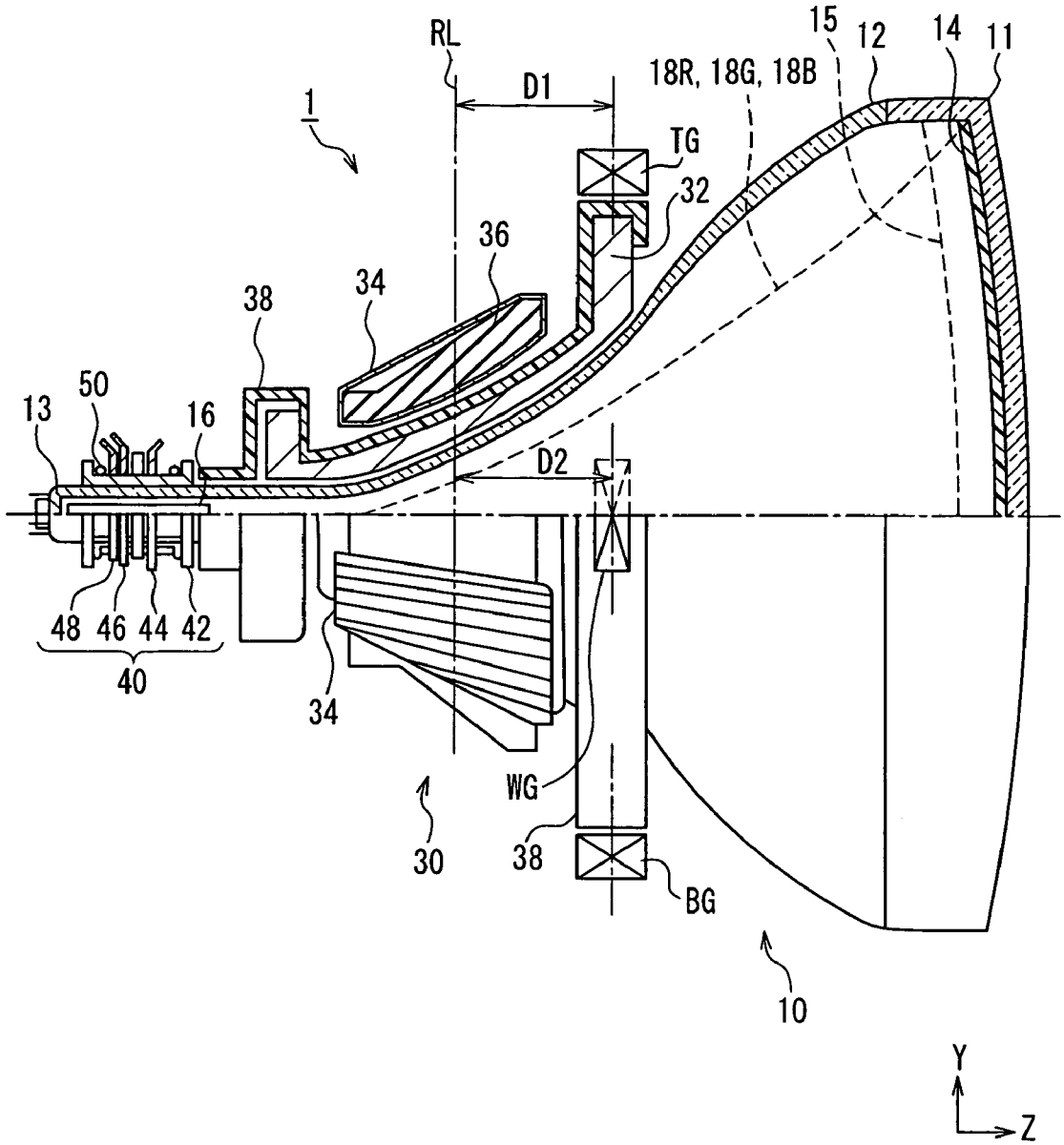
FIG. 1 is a half sectional view showing a schematic configuration of a color cathode ray tube apparatus according to an embodiment of the present invention.

FIG. 1 is a half sectional view showing a schematic configuration of the color cathode ray tube apparatus according to the embodiment of the present invention. For convenience of the following description, a tube axis is indicated by a Z axis, a horizontal axis (an axis along a longer side of a screen) is indicated by an X axis, and a vertical axis (an axis along a shorter side of the screen) is indicated by a Y axis. The X axis and the Y axis cross at right angles on the Z axis. FIG. 1 shows a cross-section above the Z axis and an external view below the Z axis.

As shown in FIG. 1, this color cathode ray tube apparatus 1 includes a color cathode ray tube 10, a deflection device 30, a CPU 40 and a velocity modulation coil 50, etc.

The color cathode ray tube 10 includes a glass bulb formed by joining a face panel 11 and a funnel 12 together, and a shadow mask 15 and an in-line electron gun (in the following, simply referred to as the "electron gun") 16 that are contained in this glass bulb.

An inner surface of the face panel 11 is provided with a phosphor screen 14 formed by arranging red, green and blue phosphor dots (or phosphor stripes) in a regular manner. The shadow mask 15 is provided at substantially a constant distance from the phosphor screen 14. The shadow mask 15 is provided with a large number of dot-shaped or slot-shaped apertures for passing electron beams. Three electron beams 18R, 18G and 18B emitted from the electron gun 16 pass through the electron beam passing apertures provided in the shadow mask 15 and illuminate desired phosphors. In the figure, only one electron beam that is on the left side when viewed from the screen side is shown because the three electron beams are arranged in a straight line parallel with the X axis.

The electron gun 16 is provided inside a neck portion 13 of the funnel 12. This electron gun 16 emits the three electron beams that are in-line arranged on a horizontal axis (the X axis), namely, a center beam 18G at the center and a pair of side beams 18R and 18B arranged in the horizontal axis direction with respect to this center beam 18G, toward the phosphor screen 14.

The electron gun 16 emits the three electron beams 18R, 18G and 18B so that their cross-sections have a horizontally-elongated shape (in other words, a substantially elliptical shape whose horizontal diameter is larger than the vertical diameter). The electron beams having such a horizontally-elongated cross-section can be formed by setting the shape of an electron beam passing aperture formed in each of grids constituting the electron gun 16, a voltage to be applied to each of the grids and lens effects of various electron lenses formed in the electron gun 16, etc. appropriately.

The deflection device 30 is provided on an outer peripheral surface of a portion connecting a large diameter portion and the neck portion 13 of the funnel 12. The deflection device 30 is a saddle-toroidal deflection device having a saddle-shaped horizontal deflection coil 32 and a toroidal-shaped vertical deflection coil 34 as main deflection coils. The vertical deflection coil 34 is wound around a ferrite core 36. The ferrite core 36 has a substantially funnel shape with a large diameter portion on a side of the phosphor screen 14 and a small diameter portion on a side of the electron gun 16. A resin frame 38 is provided between the horizontal deflection coil 32 and the vertical deflection coil 34. The resin frame 38 both maintains an electrically insulated state between the horizontal deflection coil 32 and the vertical deflection coil 34 and serves to support these deflection coils 32 and 34.

Figure 2:
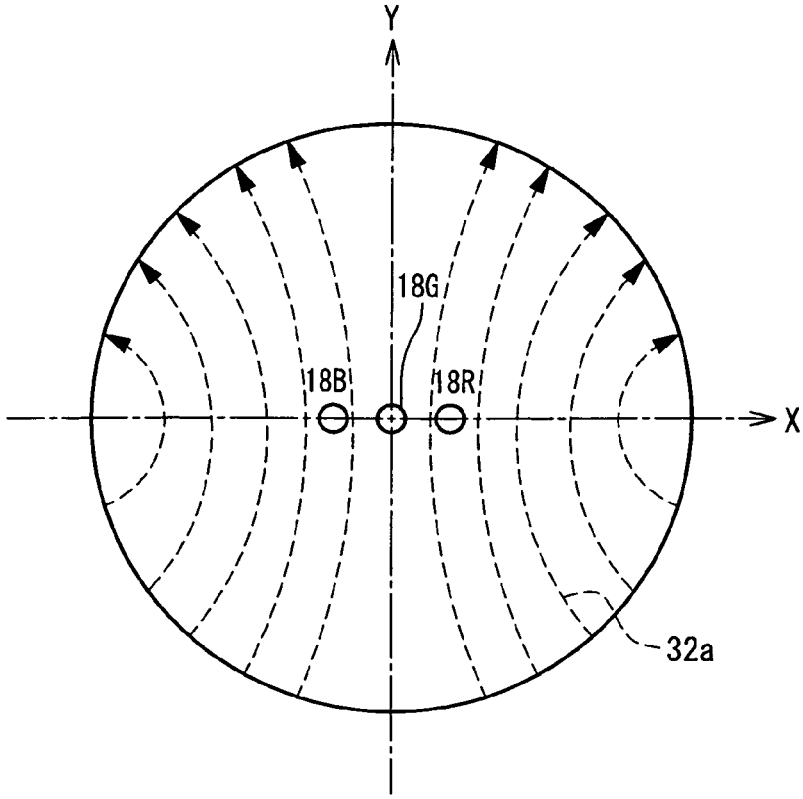
FIG. 2 shows a horizontal deflection magnetic field generated at a certain time by a horizontal deflection coil in the color cathode ray tube apparatus according to the embodiment of the present invention.
Figure 3:
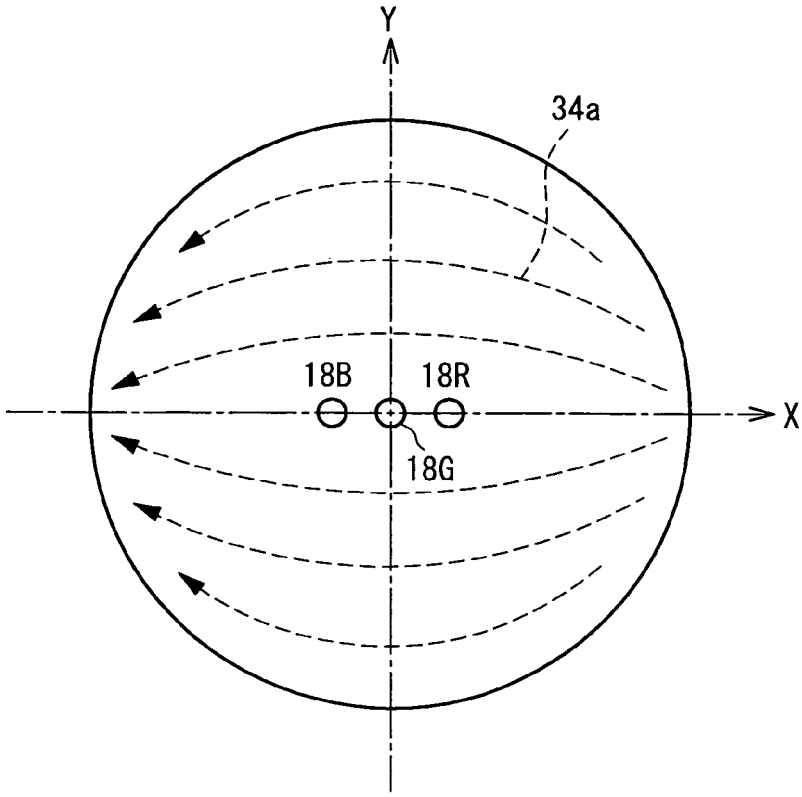
FIG. 3 shows a vertical deflection magnetic field generated at a certain time by a vertical deflection coil in the color cathode ray tube apparatus according to the embodiment of the present invention.

The horizontal deflection coil 32 generates a pincushion-shaped horizontal deflection magnetic field 32*a* indicated by broken lines in FIG. 2, and the vertical deflection coil 34 generates a barrel-shaped vertical deflection magnetic field 34*a* indicated by broken lines in FIG. 3. The three electron beams 18R, 18G and 18B emitted from the electron gun 16 are deflected horizontally and vertically by the horizontal deflection magnetic field 32*a* and the vertical deflection magnetic field 34*a* and scan the phosphor screen 14 by a raster scan system. Also, a non-uniform magnetic field formed by the horizontal deflection magnetic field 32*a* and the vertical deflection magnetic field 34*a* converges the three electron beams 18R, 18G and 18B over an entire surface of the phosphor screen 14.

The CPU 40 is provided on the outer peripheral surface of the neck portion 13 at a position overlapping the electron gun 16 in a Z-axis direction and makes a static convergence adjustment and a purity adjustment of the three electron beams 18R, 18G and 18B in a central portion of the screen. The CPU 40 includes a purity (color purification) magnet 44, a quadrupole magnet 46 and a hexapole magnet 48 that are attached to a cylindrical resin frame 42. The purity magnet 44, the quadrupole magnet 46 and the hexapole magnet 48 respectively are formed of a set of two annular magnets.

The velocity modulation coil 50 is formed of a pair of loop coils that are disposed so as to sandwich a horizontal plane including the Z axis (an XZ plane). The pair of loop coils are attached to the resin frame 42 of the CPU 40 so as to be substantially symmetrical with respect to the Z axis. The pair of loop coils are supplied with an electric current according to a velocity modulation signal obtained by differentiating a video signal. The velocity modulation coil 50 generates a vertical magnetic field so as to modulate a horizontal scanning velocity of the electron beams, thereby performing an edge enhancement of an image.

Figure 4:
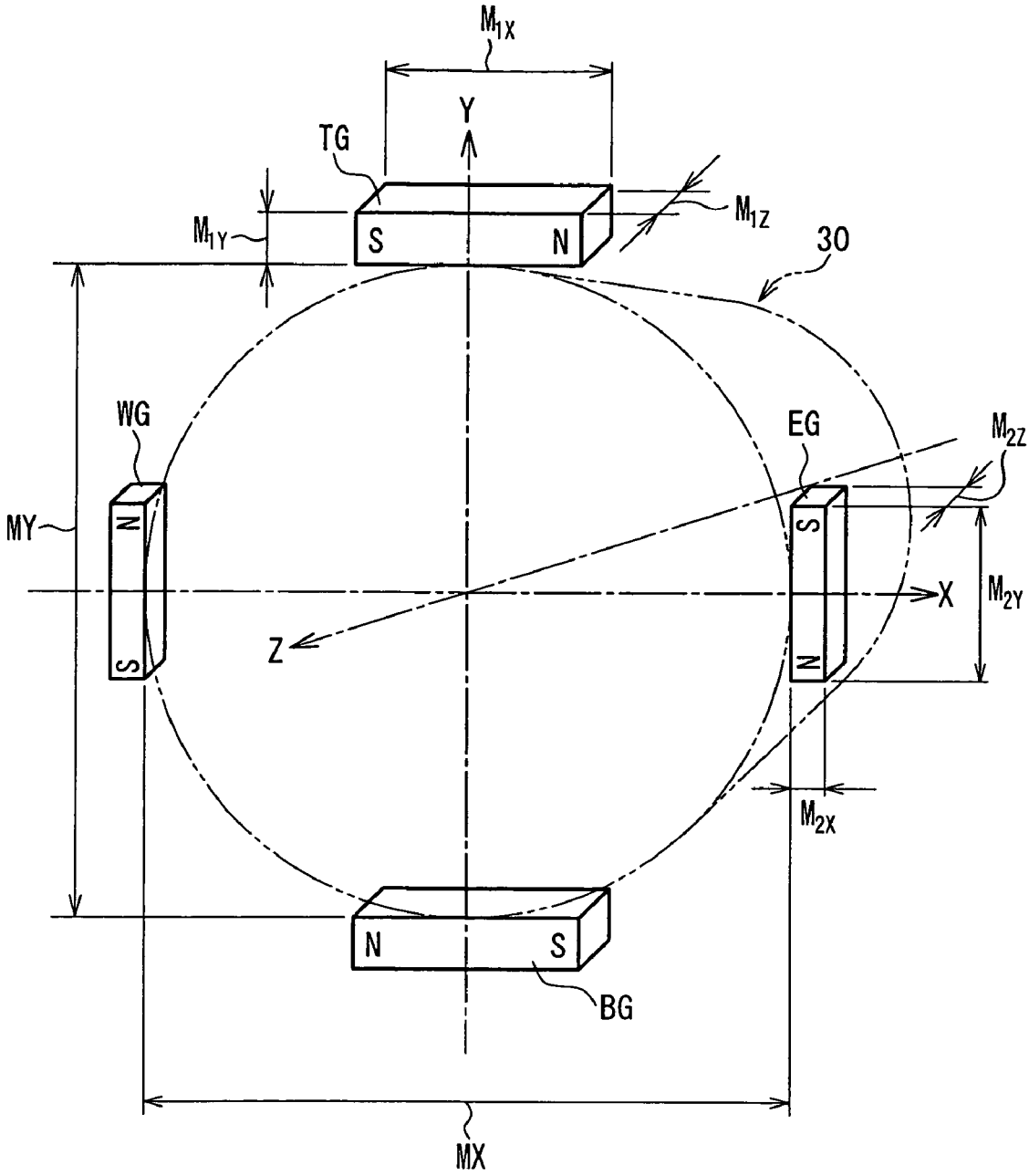
FIG. 4 is a perspective view showing an arrangement of a pair of first permanent magnets and a pair of second permanent magnets in the color cathode ray tube apparatus according to the embodiment of the present invention.

The deflection device 30 includes a pair of first permanent magnets TG, BG and a pair of second permanent magnets EG, WG near its end on the side of a large diameter portion. FIG. 4 shows the arrangement of the pair of first permanent magnets TG, BG and the pair of second permanent magnets EG, WG when viewed from the side of the large diameter portion of the deflection device 30. In FIG. 4, the deflection device 30 is simplified and indicated by a chain double-dashed line. The pair of first permanent magnets TG, BG are arranged on the Y axis symmetrically with respect to the Z axis. The pair of second permanent magnets EG, WG are arranged on the X axis symmetrically with respect to the Z axis.

Figure 5:
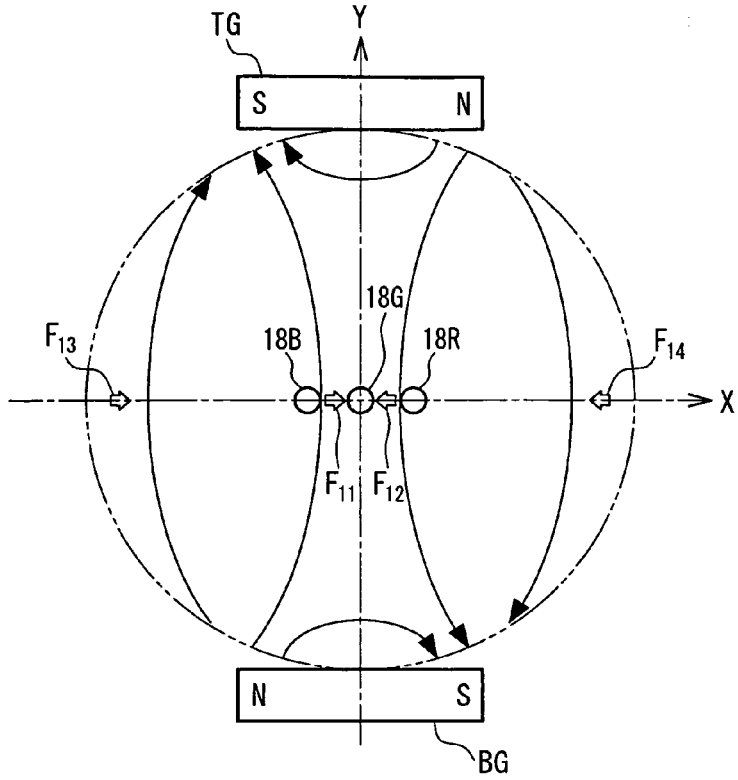
FIG. 5 shows the pair of first permanent magnets and a magnetic field formed thereby in the color cathode ray tube apparatus according to the embodiment of the present invention.

FIG. 5 shows the pair of first permanent magnets TG, BG and a magnetic field formed thereby when viewed from the side of the phosphor screen 14. Near the Z axis, the pair of first permanent magnets TG, BG generate a quadrupole magnetic field that converges the three electron beams 18R, 18G and 18B in an X-axis direction. This quadrupole magnetic field moves the electron beams 18R and 18B on both sides closer to the center electron beam 18G in the X-axis direction near the Z axis and contracts the cross-section of the center electron beam 18G in the X-axis direction near the Z axis. Arrows $F_{11}$, $F_{12}$, $F_{13}$ and $F_{14}$ indicate directions of the Lorentz forces acting on the electron beams passing respective positions in the magnetic field formed by the pair of first permanent magnets TG, BG.

Figure 6:
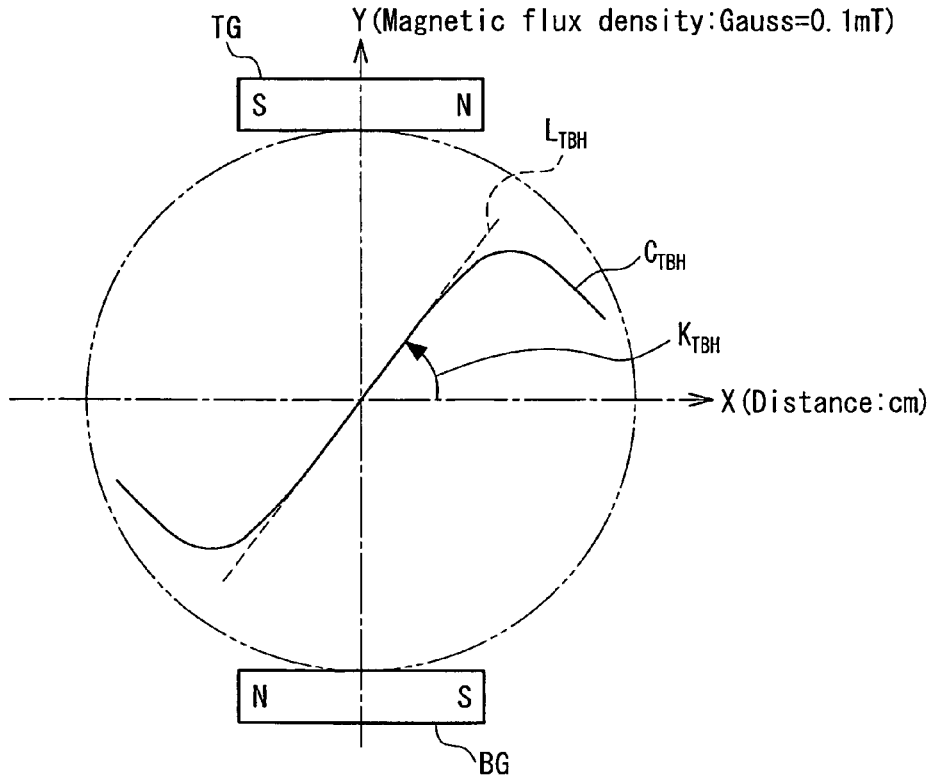
FIG. 6 shows a distribution curve on a horizontal axis of a vertical direction magnetic flux density of the magnetic field formed by the pair of first permanent magnets alone shown in FIG. 5.

FIG. 6 shows a distribution curve CTBH on the X axis of a Y-axis direction magnetic flux density of the magnetic field formed by the pair of first permanent magnets TG, BG alone shown in FIG. 5. In FIG. 6, a broken line $L_{TBH}$ is a tangent line of the curve $C_{TBH}$ near the Z axis. In the present invention, an inclination of the tangent line $L_{TBH}$ of the curve $C_{TBH}$ near the Z axis is referred to as an inclination coefficient $K_{TBH}$ (Gauss/cm) of the distribution curve $C_{TBH}$ near the Z axis on the X axis of the Y-axis direction magnetic flux density of the magnetic field formed by the pair of first permanent magnets TG, BG. Here, the inclination coefficient $K_{TBH}$ of the tangent line $L_{TBH}$ is defined based on an angle that the tangent line $L_{TBH}$ forms with the X axis, more specifically, an angle of rotation when the X axis is rotated counterclockwise until it matches with the tangent line $L_{TBH}$ as indicated by an arrow in FIG. 6.

Figure 7:
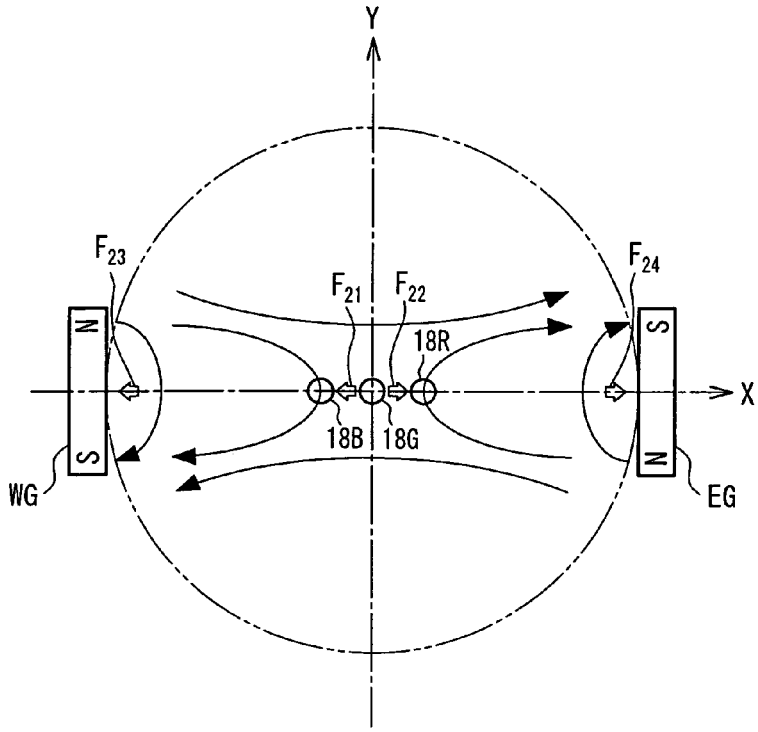
FIG. 7 shows the pair of second permanent magnets and a magnetic field formed thereby in the color cathode ray tube apparatus according to the embodiment of the present invention.

FIG. 7 shows the pair of second permanent magnets EG, WG and a magnetic field formed thereby when viewed from the side of the phosphor screen 14. Near the Z axis, the pair of second permanent magnets EG, WG generate a quadrupole magnetic field that diverges the three electron beams 18R, 18G and 18B in the X-axis direction. This quadrupole magnetic field moves the electron beams 18R and 18B on both sides away from the center electron beam 18G in the X-axis direction near the Z axis and enlarges the cross-section of the center electron beam 18G in the X-axis direction near the Z axis. Arrows $F_{21}$, $F_{22}$, $F_{23}$ and $F_{24}$ indicate directions of the Lorentz forces acting on the electron beams passing respective positions in the magnetic field formed by the pair of second permanent magnets EG, WG. As becomes clear from FIG. 7, when the three electron beams 18R, 18G and 18B are deflected toward the vicinity of screen ends in the X-axis direction, the Lorentz forces $F_{23}$ and $F_{24}$ that deflect the three electron beams 18R, 18G and 18B further outward in the X-axis direction act on the three electron beams 18R, 18G and 18B. Thus, the pair of second permanent magnets EG, WG can reduce the pincushion distortion of the right and left rasters.

Figure 8:
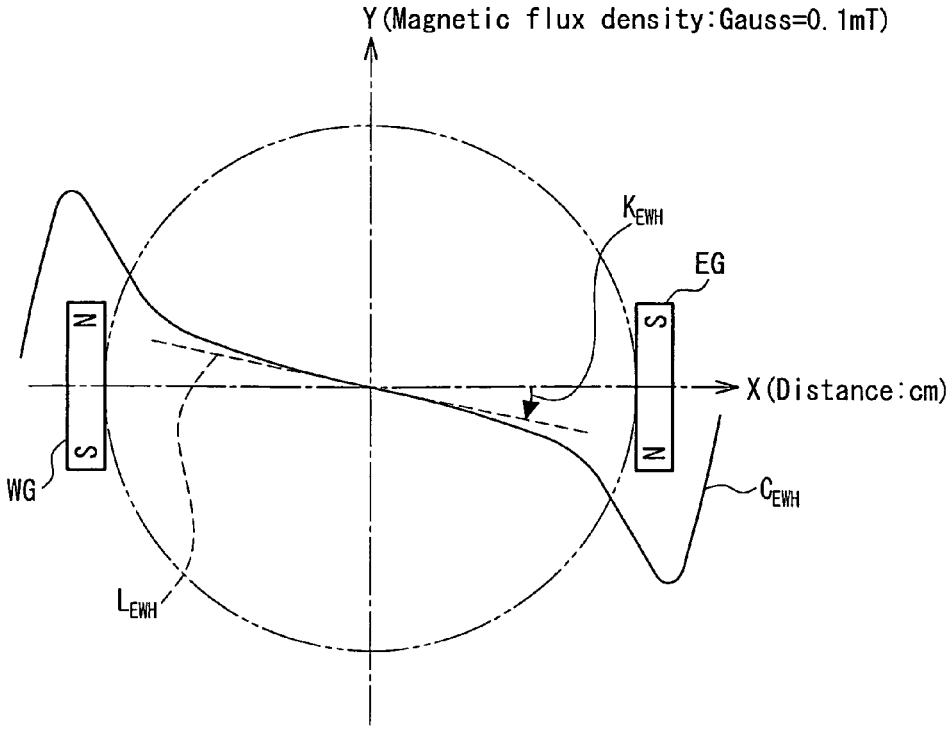
FIG. 8 shows a distribution curve on a horizontal axis of a vertical direction magnetic flux density of the magnetic field formed by the pair of second permanent magnets alone shown in FIG. 7.

FIG. 8 shows a distribution curve $C_{EWH}$ on the X axis of the Y-axis direction magnetic flux density of the magnetic field formed by the pair of second permanent magnets EG, WG alone shown in FIG. 7. In FIG. 8, a broken line $L_{EWH}$ is a tangent line of the curve $C_{EWH}$ near the Z axis. In the present invention, an inclination of the tangent line $L_{EWH}$ of the curve $C_{EWH}$ near the Z axis is referred to as an inclination coefficient $K_{EWH}$ (Gauss/cm) of the distribution curve $C_{EWH}$ near the Z axis on the X axis of the Y-axis direction magnetic flux density of the magnetic field formed by the pair of second permanent magnets EG, WG. Here, the inclination coefficient $K_{EWH}$ of the tangent line $L_{EWH}$ is defined based on an angle that the tangent line $L_{EWH}$ forms with the X axis, more specifically, an angle of rotation when the X axis is rotated clockwise until it matches with the tangent line $L_{EWH}$ as indicated by an arrow in FIG. 8.

In the present embodiment, the above-described magnetic fields formed by the pair of first permanent magnets TG, BG and the pair of second permanent magnets EG, WG assist the magnetic field generated by the main deflection coils of the deflection device 30 to deflect the three electron beams 18R, 18G and 18B. In the case where the magnetic fields generated by the main deflection coils of the deflection device 30 are the non-uniform self-convergence magnetic fields as shown in FIGS. 2 and 3, the spot shape generally becomes horizontally elongated in end portions in the horizontal direction in the screen. This mainly is attributable to the fact that the horizontal deflection magnetic field has a pincushion shape indicated by the broken lines 32*a* in FIG. 2. In the present invention, as described later, the pair of first permanent magnets TG, BG and the pair of second permanent magnets EG, WG are arranged at positions overlapping the magnetic field formed in a large-diameter-side region of the horizontal deflection coil 32 in the Z-axis direction, whereby the pincushion-shaped horizontal deflection magnetic field 32*a* shown in FIG. 2 formed by the horizontal deflection coil 32 is corrected by the quadrupole magnetic field generated by the pair of first permanent magnets TG, BG shown in FIG. 5 and the quadrupole magnetic field generated by the pair of second permanent magnets EG, WG shown in FIG. 7. Thus, the spot shapes in the end portions in the horizontal direction in the screen are improved.

As shown in FIG. 1, the pair of first permanent magnets TG, BG and the pair of second permanent magnets EG, WG are arranged on the side of the phosphor screen 14 with respect to a reference line RL in the Z-axis direction. Here, the "reference line RL" is a virtual reference line perpendicular to the Z axis, whose position on the Z axis matches with a geometrical deflection center of the cathode ray tube. It is preferable to satisfy 3 mm≦D1≦13 mm and 3 mm≦D2≦13 mm, where D1 is the distance in the Z-axis direction from the reference line RL to the pair of first permanent magnets TG, BG and D2 is the distance in the Z-axis direction from the reference line RL to the pair of second permanent magnets EG, WG. Here, the distances D1 and D2 are defined based on centers of the pair of first permanent magnets TG, BG and the pair of second permanent magnets EG, WG in the Z-axis direction, respectively.

When the distances D1 and D2 fall short of the above-noted ranges (in other words, the pair of first permanent magnets TG, BG and the pair of second permanent magnets EG, WG are arranged near the reference line RL), the respective quadrupole magnetic fields generated by the pair of first permanent magnets TG, BG and the pair of second permanent magnets EG, WG and the barrel-shaped vertical deflection magnetic field 34*a* shown in FIG. 3 formed by the vertical deflection coil 34 cancel out each other, making it difficult to achieve both the convergence characteristics and the correction of raster distortion.

When the distances D1 and D2 exceed the above-noted ranges (in other words, the pair of first permanent magnets TG, BG and the pair of second permanent magnets EG, WG are arranged near a large-diameter-side opening of the deflection device 30), the distance from the pair of first permanent magnets TG, BG and the pair of second permanent magnets EG, WG to the three electron beams traveling toward the central portion of the screen differs greatly from the distance from these permanent magnets to the three electron beams traveling toward the end portions in the horizontal direction. Accordingly, an effect of converging in the X-axis direction the three electron beams traveling toward the central portion of the screen becomes weaker, and an effect of diverging in the X-axis direction the three electron beams traveling toward the end portions in the horizontal direction becomes stronger. As a result, the difference between the spot shape in central portion of the screen and that in the end portions in the horizontal direction becomes notable, so that it becomes more difficult to achieve excellent and uniform spot shapes over the entire region of the screen.

In the present invention, the inclination coefficient $K_{TBH}$ (Gauss/cm) shown in FIG. 6 for the magnetic field formed by the pair of first permanent magnets TG, BG alone and the inclination coefficient $K_{EWH}$ (Gauss/cm) shown in FIG. 8 for the magnetic field formed by the pair of second permanent magnets EG, WG alone satisfy $K_{TBH}/K_{EWH}<10$ in at least one location within the range of 3 to 13 mm on the side of the phosphor screen with respect to the reference line RL in the Z-axis direction in an atmosphere at 25° C. In this way, it is possible to reduce the variation in convergence characteristics due to temperature variation. The reason will be given below.

In general, a magnetic force of a permanent magnet has temperature dependence. Thus, the inclination of the tangent line $L_{TBH}$ of the distribution curve $C_{TBH}$ near the Z axis on the X axis of the Y-axis direction magnetic flux density of the magnetic field formed by the pair of first permanent magnets TG, BG shown in FIG. 6 and the inclination of the tangent line $L_{EWH}$ of the distribution curve $C_{EWH}$ near the Z axis on the X axis of the Y-axis direction magnetic flux density of the magnetic field formed by the pair of second permanent magnets EG, WG shown in FIG. 8 vary with the temperature. However, the inclination of the tangent line $L_{TBH}$ and that of the tangent line $L_{EWH}$ are opposite in direction, and one of these inclinations increases with the other according to the temperature variation. Here, the inclination of the tangent line $L_{TBH}$ and that of the tangent line $L_{EWH}$ are opposite in direction because the pair of first permanent magnets TG, BG have the converging effect on the three electron beams and the pair of second permanent magnets EG, WG have the diverging effect on them in the horizontal direction. Accordingly, when the horizontally converging effect of the pair of first permanent magnets TG, BG increases due to the temperature variation, for example, the horizontally diverging effect of the pair of second permanent magnets EG, WG also increases. In this way, when the temperature varies, the variation in the Y-axis direction magnetic flux density of the magnetic field formed by the pair of first permanent magnets TG, BG and that in the Y-axis direction magnetic flux density of the magnetic field formed by the pair of second permanent magnets EG, WG cancel out each other. In the case where $K_{TBH}/K_{EWH}<10$ is satisfied, the amounts of variation in the Y-axis direction magnetic flux densities of these magnetic fields when the temperature varies balance each other appropriately. Thus, it is possible to reduce the variation in an inclination of a tangent line $L_H$ of a curve $C_H$ of a combination magnetic field near the Z axis shown in FIG. 9, which will be described later, due to the temperature variation. Consequently, the variation in convergence due to the temperature variation can be reduced.

It is preferable to satisfy $K_{TBH}/K_{EWH}<10$ in the entire range of 3 to 13 mm on the side of the phosphor screen with respect to the reference line RL in the Z-axis direction in an atmosphere at 25° C. This makes it possible to reduce the variation in convergence due to the temperature variation further.

It is preferable to satisfy $1<K_{TBH}/K_{EWH}$ in at least one location within the range of 3 to 13 mm on the side of the phosphor screen with respect to the reference line RL in the Z-axis direction in an atmosphere at 25° C. In the case where $K_{TBH}/K_{EWH}$ does not satisfy this condition, the horizontally diverging effect of the pair of second permanent magnets EG, WG on the three electron beams traveling toward the central portion of the screen becomes predominant over the horizontally converging effect of the pair of first permanent magnets TG, BG on these electron beams. Accordingly, a still larger horizontally diverging effect acts on the three electron beams traveling toward the end portions in the horizontal direction. Thus, the spot shapes notably are distorted to be horizontally-elongated, especially in the end portions in the horizontal direction of the screen. In other words, by satisfying $1<K_{TBH}/K_{EWH}$, it becomes possible to achieve excellent spot shapes over the entire screen.

It is preferable to satisfy $1<K_{TBH}/K_{EWH}$ in the entire range of 3 to 13 mm on the side of the phosphor screen with respect to the reference line RL in the Z-axis direction in an atmosphere at 25° C. This makes it possible to achieve further excellent spot shapes over the entire screen.

Figure 9:
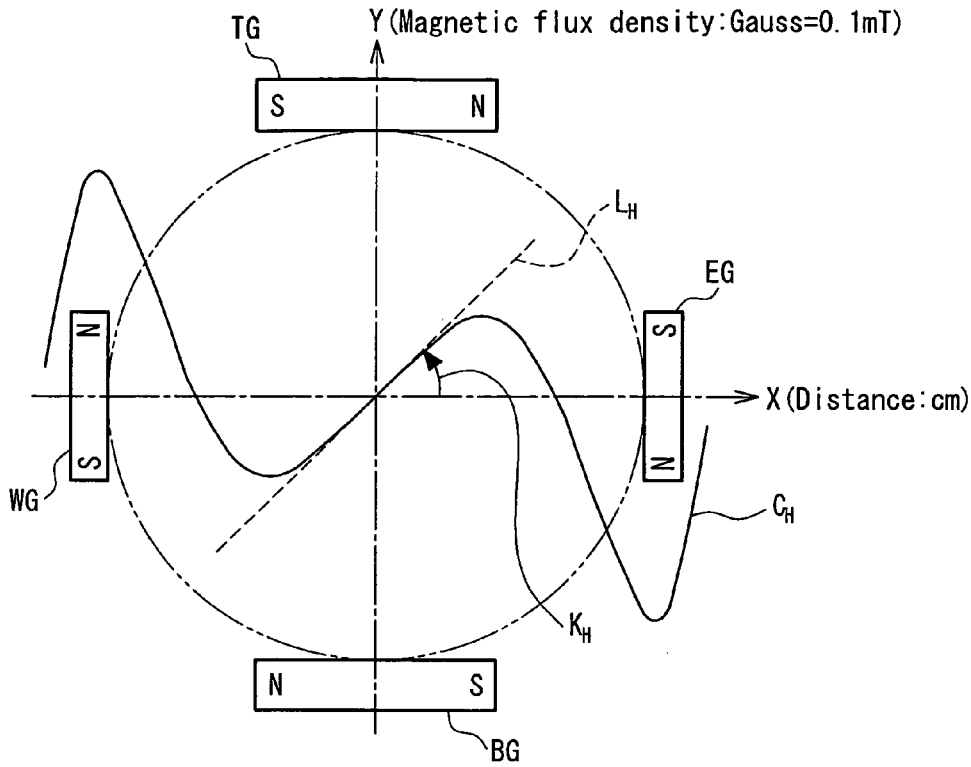
FIG. 9 shows a distribution curve on a horizontal axis of a vertical direction magnetic flux density of a combination magnetic field formed by the pair of first permanent magnets and the pair of second permanent magnets in the color cathode ray tube apparatus according to the embodiment of the present invention.

FIG. 9 shows the distribution curve $C_H$ on the X axis of the Y-axis direction magnetic flux density of the combination magnetic field of the magnetic field formed by the pair of first permanent magnets TG, BG and that formed by the pair of second permanent magnets EG, WG. In FIG. 9, a broken line $L_H$ is a tangent line of the curve $C_H$ near the Z axis. In the present invention, an inclination of the tangent line $L_H$ of the curve $C_H$ near the Z axis is referred to as an inclination coefficient $K_H$ (Gauss/cm) of the distribution curve $C_H$ on the X axis of the Y-axis direction magnetic flux density of the above-noted combination magnetic field near the Z axis. Here, the inclination coefficient $K_H$ of the tangent line $L_H$ is defined based on an angle that the tangent line $L_H$ forms with the X axis, more specifically, an angle of rotation when the X axis is rotated counterclockwise until it matches with the tangent line $L_H$ as indicated by an arrow in FIG. 9.

Figure 10:
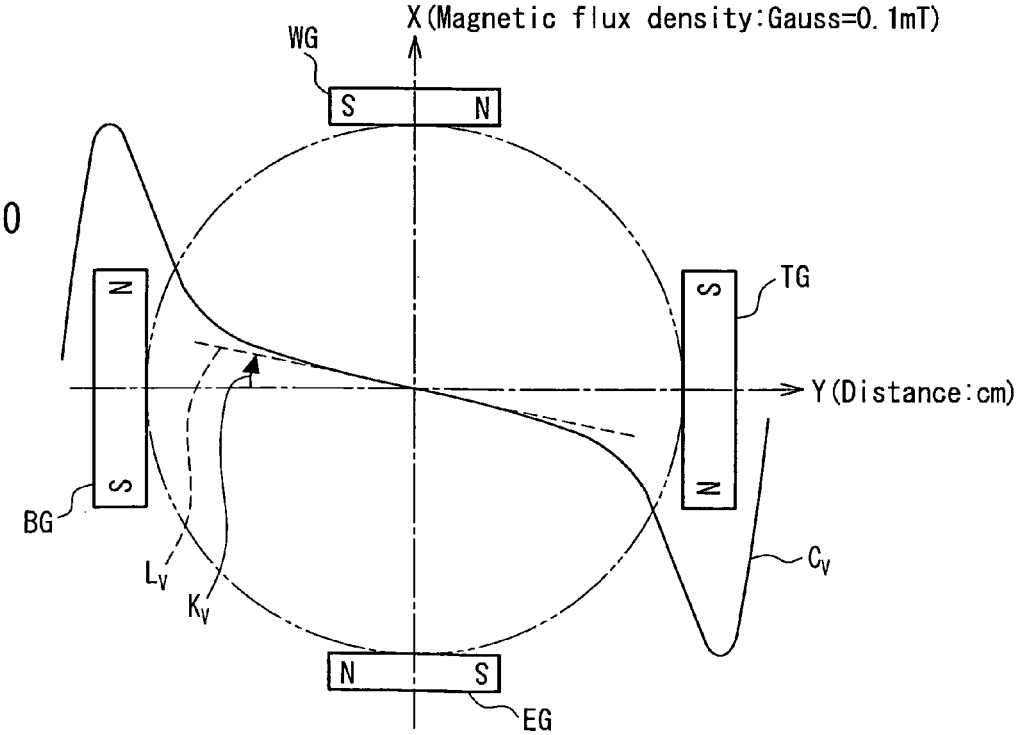
FIG. 10 shows a distribution curve on a vertical axis of a horizontal direction magnetic flux density of the combination magnetic field formed by the pair of first permanent magnets and the pair of second permanent magnets in the color cathode ray tube apparatus according to the embodiment of the present invention.

FIG. 10 shows a distribution curve $C_V$ on the Y axis of the X-axis direction magnetic flux density of the combination magnetic field formed by the pair of first permanent magnets TG, BG and the pair of second permanent magnets EG, WG. In FIG. 10, a broken line $L_V$ is a tangent line of the curve $C_V$ near the Z axis. In the present invention, an inclination of the tangent line $L_V$ of the curve $C_V$ near the Z axis is referred to as an inclination coefficient $K_V$ (Gauss/cm) of the distribution curve $C_V$ on the Y axis of the X-axis direction magnetic flux density of the above-noted combination magnetic field near the Z axis. Here, the inclination coefficient $K_V$ of the tangent line $L_V$ is defined based on an angle that the tangent line $L_V$ forms with the Y axis, more specifically, an angle of rotation when the Y axis is rotated clockwise until it matches with the tangent line $L_V$ as indicated by an arrow in FIG. 10.

In the present invention, the inclination coefficient $K_H$ (Gauss/cm) and the inclination coefficient $K_V$ (Gauss/cm) described above satisfy $K_H>1.5$ and $K_V>1.5$ in at least one location within the range of 3 to 13 mm on the side of the phosphor screen with respect to the reference line RL in the Z-axis direction in an atmosphere at 25° C. This makes it possible to achieve less-distorted spots whose diameter is small in both of the X-axis direction and the Y-axis direction over the entire region of the screen.

It is preferable to satisfy $K_H>1.5$ and $K_V>1.5$ in the entire range of 3 to 13 mm on the side of the phosphor screen with respect to the reference line RL in the Z-axis direction in an atmosphere at 25° C. This makes it possible to achieve even less-distorted spots whose diameter is even smaller in both of the X-axis direction and the Y-axis direction over the entire region of the screen.

It is preferable that the pair of first permanent magnets TG, BG and the pair of second permanent magnets EG, WG respectively have characteristics such that their magnetic forces decrease with an increase in temperature, namely, a positive temperature coefficient with respect to the magnetic force. This allows the use of a permanent magnet made of a commonly used material such as ferrite, for example, thus making it possible to lower the cost.

Figure 11:
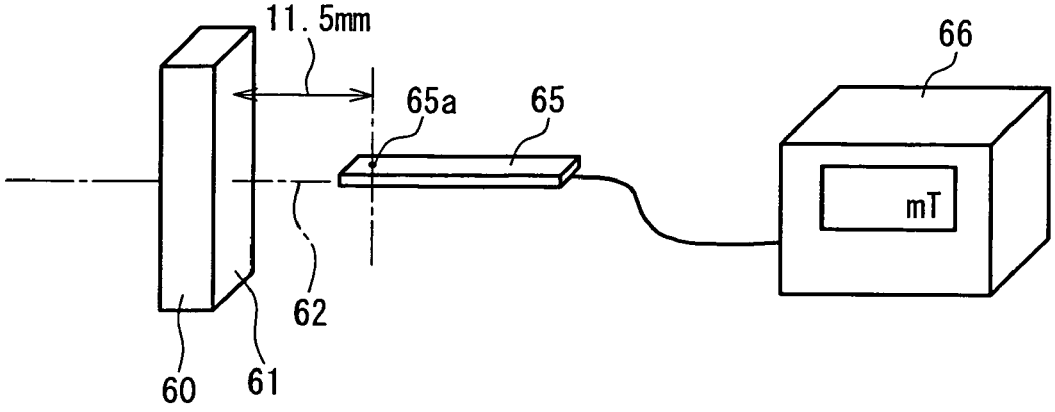
FIG. 11 illustrates how to measure a magnetic force of a permanent magnet.
Figure 12:
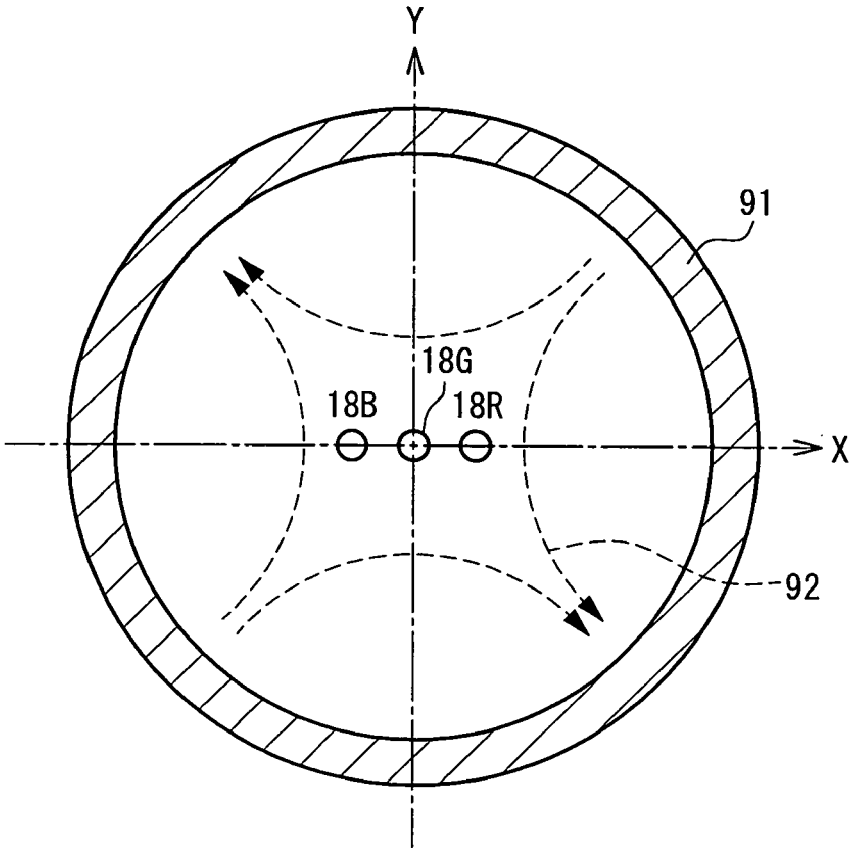
FIG. 12 PRIOR ART
FIG. 12 is a sectional view taken from a screen side showing a quadrupole magnetic field generated by an auxiliary magnetic field generating device provided in a conventional color cathode ray tube apparatus.

FIG. 11 shows how to measure the magnetic force of a permanent magnet. A magnetic field measuring probe 65 is placed so as to face an end face 61 of a permanent magnet 60, which is an object to be measured. At this time, a measurement point 65*a* of the probe 65 is at a position that is located on a normal line 62 passing though a center point of the end face 61 and at a distance of 11.5 mm from the end face 61. Here, the end face 61 is a surface facing the Z axis when the permanent magnet 60 is mounted on the deflection device 30. In this manner, a magnetic flux density at the measurement point 65*a* is determined by an arithmetic unit 66, thus obtaining the magnetic force of the permanent magnet 60. The measurement is made at 25° C. It is preferable that the magnetic force (magnetic flux density) measured as above is 2.7 to 3.7 mT for each of the pair of first permanent magnets TG, BG and 0.6 to 1.1 mT for each of the pair of second permanent magnets EG, WG. The magnetic force of the pair of first permanent magnets TG, BG smaller than the above-noted range increases the spot distortion, while that larger than the above-noted range increases the variation in convergence due to the temperature variation. The magnetic force of the pair of second permanent magnets EG, WG smaller than the above-noted range increases both of the variation in convergence due to the temperature variation and the pincushion distortion of right and left rasters, while that larger than the above-noted range increases the spot distortion.

At least one of the permanent magnets TG, BG, EG and WG may be a compound magnet, which is a combination of a plurality of permanent magnets. Although there is no particular limitation on how to combine the plurality of permanent magnets, examples thereof can include stacking the plurality of magnets in a direction perpendicular to the Z axis, stacking the plurality of magnets in a direction parallel with the Z axis, joining the plurality of magnets along their longitudinal direction, etc. By changing the combination of the permanent magnets according to a screen size, etc. of the cathode ray tube apparatus, it becomes unnecessary to prepare dedicated permanent magnets for individual specifications of the cathode ray tube apparatuses. Consequently, the overall number of kinds of the permanent magnets can be reduced.

EXAMPLE

The following is a result of an experiment using a 21-inch color cathode ray tube apparatus with a deflection angle of 90°.

As shown in FIG. 4, the pair of first permanent magnets TG, BG and the pair of second permanent magnets EG, WG were attached near the end on the side of the large diameter portion (on the side of the phosphor screen with respect to the reference line RL) of the deflection device 30. The orientation of magnetic poles of each of the permanent magnets was as shown in FIG. 4. As each of the permanent magnets, a magnet formed by molding ferrite into a rectangular prism was used. The first permanent magnets TG, BG had a dimension in the X-axis direction $M_{1X}$, a dimension in the Y-axis direction $M_{1Y}$ and a dimension in the Z-axis direction $M_{1Z}$ of $M_{1X}$=52.0 mm, $M_{1Y}$=10.6 mm and $M_{1Z}$=8.5 mm, respectively. The second permanent magnets EG, WG had a dimension in the X-axis direction $M_{2X}$, a dimension in the Y-axis direction $M_{2Y}$ and a dimension in the Z-axis direction $M_{2Z}$ of $M_{2x}$=5.0 mm, $M_{2Y}$=30.0 mm and $M_{2Z}$=3.0 mm, respectively. The space in the Y-axis direction MY between respective surfaces of the pair of first permanent magnets TG, BG facing the Z axis was MY=97 mm, and the space in the X-axis direction MX between respective surfaces of the pair of second permanent magnets EG, WG facing the Z axis was MX=97 mm. The respective distances D1 and D2 along the Z-axis direction from the reference line RL to the pair of first permanent magnets TG, BG and the pair of second permanent magnets EG, WG were set to D1=D2=9 mm.

The magnetic force (the magnetic flux density at a point 11.5 mm away from the end face) of the permanent magnet measured by the method illustrated by FIG. 11 was 3.2 mT for both of the first permanent magnets TG, BG and 0.88 mT for both of the second permanent magnets EG, WG.

In the combination magnetic field formed by the pair of first permanent magnets TG, BG and the pair of second permanent magnets EG, WG, the inclination coefficient $K_H$ (Gauss/cm) described in FIG. 9 and the inclination coefficient $K_V$ (Gauss/cm) described in FIG. 10 were $K_H$=1.91 and $K_V$=2.25 at a point 11 mm away from the reference line RL on the side of the phosphor screen along the Z axis.

In the magnetic field formed by the pair of first permanent magnets TG, BG alone, the inclination coefficient $K_{TBH}$ (Gauss/cm) described in FIG. 6 was $K_{TBH}$=2.44, and in the magnetic field formed by the pair of second permanent magnets EG, WG alone, the inclination coefficient $K_{EWH}$ (Gauss/cm) described in FIG. 8 was $K_{EWH}$=0.49, both at a point 11 mm away from the reference line RL on the side of the phosphor screen along the Z axis. The ratio thereof was $K_{TBH}/K_{EWH}$=5.

The color cathode ray tube apparatus described above was produced as Example 1.

Color cathode ray tube apparatuses of Example 2 and Comparative Examples 1 to 3 were produced similarly to the above except that their magnetic forces were changed by changing the dimensions of the pair of first permanent magnets TG, BG and the pair of second permanent magnets EG, WG. Tables 1 and 2 show the magnetic forces of the permanent magnets and the inclination coefficients $K_H$, $K_V$, $K_{TBH}$ and $K_{EWH}$ at a point 11 mm away from the reference line RL along the Z axis on the side of the phosphor screen for Examples 1 and 2 and Comparative Examples 1 to 3. In the entire range of 3 to 13 mm on the side of the phosphor screen with respect to the reference line RL, none of Comparative Examples 1 to 3 satisfied $K_H$>1.5 and $K_V$>1.5, and Comparative Example 1 did not satisfy $K_{TBH}/K_{EWH}$<10.

[Evaluation]

The color cathode ray tube apparatuses of Examples 1 and 2 and Comparative Examples 1 to 3 were evaluated from the following aspects.

(1) Spot Shape

The spot shapes in the screen of the color cathode ray tube apparatus were measured. The measurement was made as follows. By adjusting a voltage to be applied to a focusing electrode (a focus voltage) while keeping a beam current constant at 2.5A, the focus state on the screen was optimized. In this state, the diameter in the X-axis direction $D_H$ and the diameter in the Y-axis direction $D_V$ of the spots were measured. The measurement was made at four locations, i.e., a point near the center of the screen ("Center"), a point near the end in the X-axis direction of the screen ("X end"), a point near the end in the Y-axis direction of the screen ("Y end") and a point near the end in a diagonal-axis direction of the screen ("D end"). The screen was divided by the X axis and the Y axis into four quadrants. In each quadrant, the measurement was made at the four locations described above, thus calculating an average ($D_{HAV}$, $D_{VAV}$) of the measurement values in the four quadrants. From the average diameter in the X-axis direction $D_{HAV}$ and the average diameter in the Y-axis direction $D_{VAV}$ obtained above, the ratio R(=$D_{HAV}/D_{VAV}$) and the sum S(=$D_{HAV}+D_{VAV}$) were calculated.

Table 1 shows the result.

TABLE 1

| | Magnetic force of permanent magnet (mT) | | Inclination coefficient (Gauss/cm) | | Spot shape | | | | | | | |
|---|---|---|---|---|---|---|---|---|---|---|---|---|
| | | | | | Ratio R | | | | Sum S (mm) | | | |
| | | | | | | X | Y | D | | X | Y | D |
| | TG, BG | EG, WG | $K_H$ | $K_V$ | Center | end | end | end | Center | end | end | end |
| Ex. 1 | 3.2 | 0.88 | 1.91 | 2.25 | 0.9 | 2.3 | 1.2 | 1.4 | 2.7 | 3.2 | 3.0 | 4.0 |
| Ex. 2 | 2.78 | 0.64 | 1.57 | 1.84 | 0.9 | 2.3 | 1.2 | 1.5 | 2.8 | 3.2 | 3.0 | 4.0 |
| Comp. Ex. 1 | 3.48 | 0.33 | 1.04 | 1.23 | 1.2 | 2.4 | 1.2 | 1.6 | 3.1 | 3.2 | 3.0 | 4.0 |
| Comp. Ex. 2 | 2.6 | 1.69 | 0.93 | 1.16 | 1.2 | 2.4 | 1.2 | 1.6 | 3.1 | 3.2 | 3.0 | 4.0 |
| Comp. Ex. 3 | 3.3 | 1.2 | 0.74 | 0.94 | 1.2 | 2.4 | 1.2 | 1.8 | 3.1 | 3.3 | 3.1 | 4.6 |

As becomes clear from Table 1, in Examples 1 and 2 where the inclination coefficients $K_H$ and $K_V$ satisfy $K_H$>1.5 and $K_V$>1.5 in at least one location within the range of 3 to 13 mm on the side of the phosphor screen with respect to the reference line RL, the ratio R between the average spot shape diameter in the X-axis direction $D_{HAV}$ and the average spot shape diameter in the Y-axis direction $D_{VAV}$ was close to 1 in every location in the screen, so that excellent spot shapes with less distortion in the horizontal and vertical directions were obtained. Incidentally, regarding the sum S of the spot diameters in the horizontal and vertical directions, Examples 1 and 2 sometimes did not show a significant difference from Comparative Examples 1 to 3 especially in the peripheral portion of the screen. However, no problem occurred in practice as long as the spots had a size approximate to that obtained in Examples 1 and 2.

(2) Variation in Convergence

The variation in convergence characteristics due to variation in an environmental temperature of the color cathode ray tube apparatus was measured. The measurement was made as follows. The color cathode ray tube apparatus was operated in an environment whose ambient temperature was 0° C. for at least 3 hours so as to stabilize the temperature variation of the cathode ray tube 10 and the deflection device 30. In this state, the convergence was measured. Next, after the ambient temperature was changed to 40° C., the color cathode ray tube apparatus was operated for at least 3 hours, and then the convergence was measured similarly. Taking note of two vertical lines formed by the electron beams 18R and 18B on both sides respectively corresponding to red and blue, the direction and amount of movement of the red vertical line with respect to the blue vertical line when the environmental temperature was changed from 0° C. to 40° C. were measured. The measurement was made at two locations, i.e., a point near the center of the screen ("Center") and a point near the end in the X-axis direction of the screen ("X end"). The screen was divided by the X axis and the Y axis into four quadrants. In each quadrant, the measurement was made at the two locations described above, thus calculating an average of the measurement values in the four quadrants.

Table 2 shows the result.

TABLE 2

| | Inclination coefficient (Gauss/cm) | | Ratio | Variation in convergence Movement direction/movement amt. (mm) | |
|---|---|---|---|---|---|
| | $K_{TBH}$ | $K_{EWH}$ | $K_{TBH}/K_{EWH}$ | Center | X end |
| Ex. 1 | 2.44 | 0.49 | 5 | Right/0.17 mm | Right/0.28 mm |
| Ex. 2 | 1.78 | 0.21 | 8.48 | Right/0.19 mm | Right/0.31 mm |
| Comp. Ex. 1 | 1.06 | 0.02 | 50.00 | Right/0.42 mm | Right/0.81 mm |
| Comp. Ex. 2 | 1.71 | 0.79 | 2.17 | Right/0.15 mm | Right/0.29 mm |
| Comp. Ex. 3 | 0.99 | 0.25 | 3.95 | Right/0.17 mm | Right/0.30 mm |

In Comparative Example 1 where the ratio $K_{TBH}/K_{EWH}$ exceeded the range of the present invention in the entire range of 3 to 13 mm on the side of the phosphor screen with respect to the reference line RL, the variation in convergence characteristics due to temperature variation was large. In the case of satisfying $K_{TBH}/K_{EWH}<10$ in at least one location within the range of 3 to 13 mm on the side of the phosphor screen with respect to the reference line RL, it was possible to reduce the variation in convergence characteristics due to temperature variation.

The present invention is utilized in any fields without any particular limitation. For example, the present invention can be utilized widely in color cathode ray tube apparatuses for a television or a computer display in which a higher resolution and a lower cost are demanded.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color cathode ray tube apparatus comprising:

a color cathode ray tube comprising an electron gun for emitting three electron beams that are aligned in a horizontal direction, and a phosphor screen that emits light when struck by the three electron beams emitted from the electron gun; and a deflection device comprising a horizontal deflection coil that generates a horizontal deflection magnetic field for deflecting the three electron beams in the horizontal direction, and a vertical deflection coil that generates a vertical deflection magnetic field for deflecting the three electron beams in a vertical direction;

wherein the deflection device further comprises a pair of first permanent magnets that are arranged on a vertical axis symmetrically with respect to a tube axis so that the three electron beams are converged in the horizontal direction near the tube axis and a pair of second permanent magnets that are arranged on a horizontal axis symmetrically with respect to the tube axis so that the three electron beams are diverged in the horizontal direction near the tube axis, $K_{TBH}/K_{EWH}<10$ is satisfied in at least one location within a range of 3 to 13 mm on a side of the phosphor screen with respect to a reference line in a tube axis direction, where $K_{TBH}$ (Gauss/cm) is an inclination coefficient of a distribution curve near the tube axis on the horizontal axis of a vertical direction magnetic flux density of a magnetic field formed by the pair of first permanent magnets and $K_{EWH}$ (Gauss/cm) is an inclination coefficient of the distribution curve near the tube axis on the horizontal axis of a vertical direction magnetic flux density of a magnetic field formed by the pair of second permanent magnets, and $K_H>1.5$ and $K_V>1.5$ are satisfied in at least one location within the range of 3 to 13 mm on the side of the phosphor screen with respect to the reference line in the tube axis direction, where $K_H$ (Gauss/cm) is an inclination coefficient of a distribution curve near the tube axis on the horizontal axis of a vertical direction magnetic flux density of a combination magnetic field formed by the pair of first permanent magnets and the pair of second permanent magnets and $K_V$ (Gauss/cm) is an inclination coefficient of a distribution curve near the tube axis on the vertical axis of a horizontal direction magnetic flux density of the combination magnetic field.

2. The color cathode ray tube apparatus according to claim 1, wherein the pair of first permanent magnets and the pair of second permanent magnets are arranged within the range of 3 to 13 mm on the side of the phosphor screen with respect to the reference line in the tube axis direction.

3. The color cathode ray tube apparatus according to claim 1, satisfying $K_{TBH}/K_{EWH}<10$ in an entire range of 3 to 13 mm on the side of the phosphor screen with respect to the reference line in the tube axis direction.

4. The color cathode ray tube apparatus according to claim 1, satisfying $1<K_{TBH}/K_{EWH}$ in at least one location within the range of 3 to 13 mm on the side of the phosphor screen with respect to the reference line in the tube axis direction.

5. The color cathode ray tube apparatus according to claim 1, satisfying $1<K_{TBH}/K_{EWH}$ in an entire range of 3 to 13 mm on the side of the phosphor screen with respect to the reference line in the tube axis direction.

6. The color cathode ray tube apparatus according to claim 1, satisfying $K_H>1.5$ and $K_V>1.5$ in an entire range of 3 to 13 mm on the side of the phosphor screen with respect to the reference line in the tube axis direction.

7. The color cathode ray tube apparatus according to claim 1, wherein a magnetic force of each of the pair of first permanent magnets at a point 11.5 mm away from a center point of an end face thereof is 2.7 to 3.7 mT, and a magnetic force of each of the pair of second permanent magnets at a point 11.5 mm away from a center point of an end face thereof is 0.6 to 1.1 mT.

8. The color cathode ray tube apparatus according to claim 1, wherein at least one of the pair of first permanent magnets and the pair of second permanent magnets is a combination of a plurality of permanent magnets.

* * * * *